US006109447A

United States Patent [19]

Cabana

[11] Patent Number: 6,109,447

[45] Date of Patent: Aug. 29, 2000

[54] SYSTEM FOR SHIPPING AND DISPLAYING SMALL ARTICLES

[75] Inventor: Dan Cabana, Garden Ridge, Tex.

[73] Assignee: Rooster Products International, Inc., San Antonio, Tex.

[21] Appl. No.: 08/668,340

[22] Filed: Jun. 25, 1996

[51] Int. Cl.[7] ..... B65D 5/50

[52] U.S. Cl. ..... 206/764; 206/526; 206/774; 53/471; 229/122

[58] Field of Search ..... 206/736, 756, 206/279, 289, 292, 298, 525, 526, 764, 774; 211/57.1, 59.1, 181; 53/478, 485, 488, 173, 467, 471; 229/122

[56] References Cited

U.S. PATENT DOCUMENTS

| | | | |
|---|---|---|---|
| 1,311,975 | 8/1919 | Kroff . | |
| 2,215,695 | 9/1940 | Ginsberg . | |
| 3,265,216 | 8/1966 | Samsing | 211/57.1 |
| 3,369,652 | 2/1968 | Bebout . | |
| 3,961,710 | 6/1976 | Creamer . | |
| 4,184,625 | 1/1980 | Stollberg et al. | 206/526 |
| 4,324,380 | 4/1982 | Rothenberg . | |
| 4,363,405 | 12/1982 | Christie | 206/526 |
| 4,484,681 | 11/1984 | Consiglio, Jr. | 206/526 |
| 4,842,131 | 6/1989 | Mandelbaum | 206/756 |
| 5,249,668 | 10/1993 | Fenton et al. | 206/756 |
| 5,489,023 | 2/1996 | Havlovitz | 206/526 |

*Primary Examiner*—Paul T. Sewell
*Assistant Examiner*—Luan K. Bui
*Attorney, Agent, or Firm*—Jenkens & Gilchrist

[57] ABSTRACT

A system for shipping and displaying small articles, the system having three parts consisting of rectangular display box with an open top; a metal rack to carry the goods thereon, which fits within the display box; and a shipping carton, which has an open bottom designed to slip over the top of the display box when the rack is in the box. When the goods are shipped hanging on the metal rack, the only step required for display at the retail end is removal of the shipping carton from the display box and placement of the display box, with the goods hanging from the display rack within the box, on the retail sales floor.

11 Claims, 2 Drawing Sheets

SYSTEM FOR SHIPPING AND DISPLAYING SMALL ARTICLES

FIELD OF THE INVENTION

A system for shipping and displaying small articles, more specifically, a system comprising a metal rack, a display box, and a shipping box.

BACKGROUND OF THE INVENTION

Typically, manufacturers of small goods and articles intended for retail sale will pack a number of the small articles, for example, gloves, in a cardboard box for shipping to the retailer. When the box is received at the retailer, a worker will open the box, unpack the items to be displayed, and place the items on a display in the retail sale section of the store. This is, however, a time-consuming process for the retailer. Clearly, utility would lie in a system that would allow fewer steps, especially at the retailer's end, required to display the articles. Specifically, utility would lie in a system in which the articles arrive at the retailer ready for display, rather than requiring unpacking and display arrangement of individual articles at the retailer end.

OBJECT OF THE INVENTION

It is an object of the present invention to provide for convenience, namely convenience to a retailer when receiving from a manufacturer a shipment containing numerous small articles intended for display at the retailer's sales outlet.

It is a further object of the present invention to provide a system for safely shipping numerous small articles intended for display in a retail sales outlet, while allowing for quick display at the retailer end.

It is a further object of the present invention to provide for a system of shipping numerous small articles intended for display in a retail sales outlet, which system allows for the retailer to perform a single act of removing a shipping box in order to display the goods for retail sale.

It is a further object of the present invention to provide for a system of shipping numerous small articles intended for retail sales outlet in which the small articles are sorted and hung from a display rack and placed in a display box before shipping to the retailer.

SUMMARY OF THE INVENTION

These and other objects are provided for in a system comprising three main components: a free-standing, typically metal display rack capable of receiving, mounted thereon, the goods to be displayed; a display box, typically cardboard and open at the top, dimensioned to receive the free-standing metal rack with the goods loaded thereon and typically cut down at the sides and front, so that the goods to be displayed are visible from above the front and sides of the display box; and a shipping container, typically cardboard and open at the bottom, dimensioned to slip over the top of the display box with the metal rack therein and to snugly enclose the sides of the display box.

DESCRIPTION OF THE PREFERRED EMBODIMENT

Figure 1A:
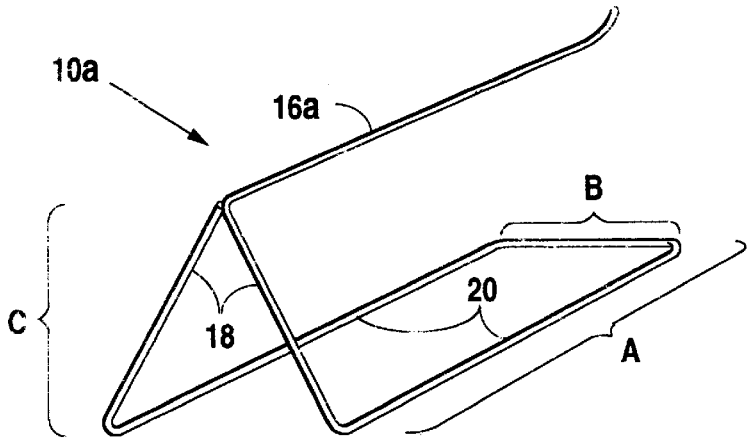
FIGS. 1A and 1B illustrate, in perspective view, two embodiments of the display rack of the present invention.
Figure 1B:
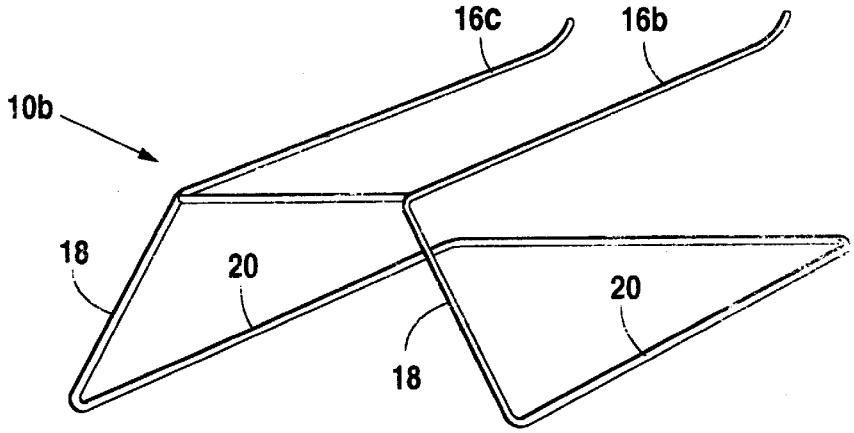

Turning to FIGS. 1A and 1B, two alternate preferred embodiments of the present invention, are illustrated, namely mainly free-standing, typically metal display racks (10*a*) and (10*b*) capable of displaying goods thereon.

Figure 2:
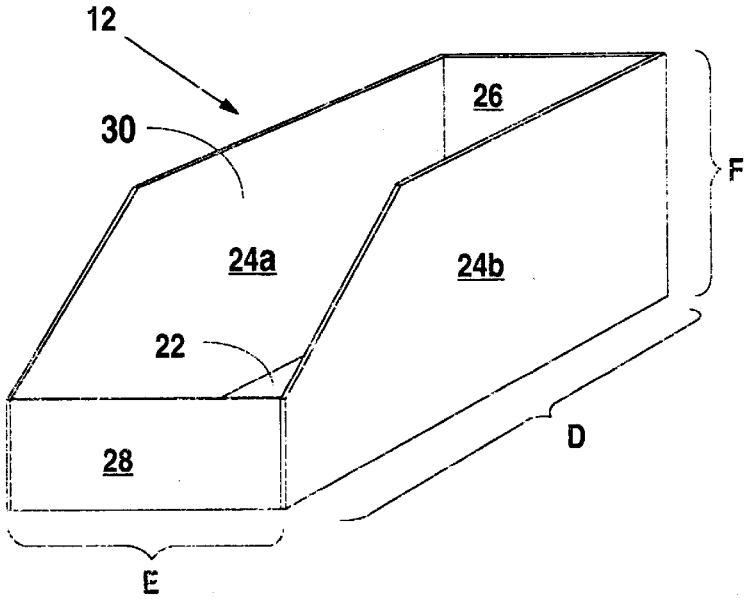
FIG. 2 illustrates, in perspective view, the display box of the present invention.

FIG. 2 illustrates a display box (12), typically made of cardboard and open at the top, dimensioned to receive the display rack therein, typically so that the articles contained on the display rack are visible above or from the front of display box (12).

Figure 3:
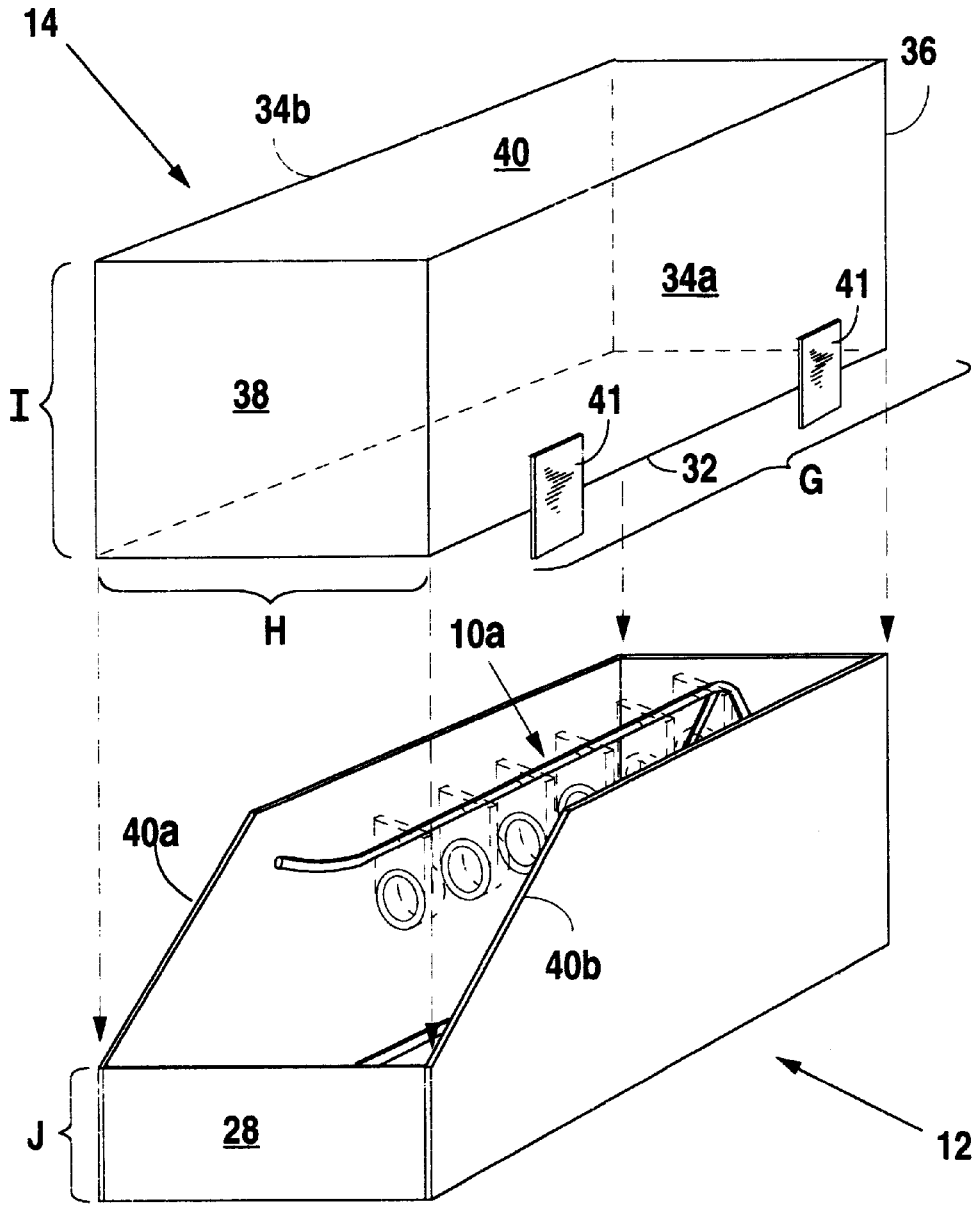
FIG. 3 illustrates, in perspective, exploded view, the display box with the rack set therein, in which goods have been placed, and the shipping carton of the present invention.

FIG. 3 illustrates the third component of applicant's system, namely a shipping carton (14) typically open at the bottom and designed to slide down over the top of the display box 12 having metal racks (10*a* or 10*b*) located therein and loaded with articles. After shipping carton (14) is slid over display box (12), tape or other means it utilized to secure the bottom of the display box to the sides of the shipping carton.

Turning back to FIGS. 1A and 1B, it is seen how the display racks (10*a*) and (10*b*) are comprised of arms (16*a*), (16*b*) and (16*c*), which arms are supported by support members (18), which support members are vertically mounted to base (20). The entire display rack referenced (10*a*) can be made from a single piece of ¼ to ⅜" metal rod bent to the illustrated shape. Display racks (10*a*) and (10*b*) are typically made of steel rod approximately ¼ inch in diameter, bent in the configuration illustrated. Arms (16*a*), (16*b*) and (16*c*) are typically tilted up slightly (1–2") from the horizontal, that is, from the plane of base (20), this helps the arm stand straight out as it is loaded with goods and flexes downward under their weight. The display rack (10*a*) has a single arm (16*a*) whereas display rack (10*b*) has a pair of arms (16*b*) and (16*c*) spaced apart and above base (20). The function of the arms, typically attached at a proximal end by supports (18) and free at a removed end, is to receive thereon, typically in a hanging fashion, the articles to be displayed (see FIG. 3). Frequently such articles are themselves mounted to a cardboard tag or label which, in turn, has a hole near the top so as to be suspended from the arms. The arms may be longer than the length of the bases (dimension A).

The function of supports (18) is just that—to support the arms. The supports are, in turn, mounted on a base (20).

With reference now to FIGS. 1A, 1B, 2 and 3, it is seen that dimensions A, D and G represent the length of the display rack, display box, and shipping carton, respectively. Dimensions B, E and H represent the corresponding widths; and dimensions C, F and I represent the corresponding heights. Typically, length A and width B are slightly smaller than the corresponding length D and width E of display box (12) so the display box fits snugly with its base up against the inner walls of the display box as the base rests against a floor (22) of the display box.

Display box (12) is seen to have the floor (22), a pair of upstanding side walls (24*a*) and (24*b*), a rear wall (26), and a front wall (28). Reference numeral (30) represents the open top of the display box. Shipping carton (14) is, like display box (12), typically rectangular and includes an bottom (32), a pair of side walls (34*a*) and (34*b*), a rear wall (36), and a front wall (38). Shipping carton (14) has a closed top represented by top wall (40).

It may also be appreciated how, with reference to FIG. 3, dimensions D and E of the display box are slightly smaller than corresponding dimensions G and H on the shipping carton so that the shipping carton may be lowered over the display box, such that walls (24*a*), (24*b*), (26) and (28) are snug and flush against the inner surfaces of walls (34*a*) and (34*b*) and (36) and (38), respectively. Moreover, sliding shipping carton (14) over the display box so that the lower edges of side walls (34*a*) and (34*b*) are flush with the lower edges of side walls (24*a*) and (24*b*), with the inner surfaces of the shipping carton flush with the outer surfaces of the walls of the display box, will create a closed unit with bottom (22) complete obscuring open bottom (32) and closed top (40), completely covering open top wall (30). It is to be noted that the height of side walls (24*a*) and (24*b*) may be cut down so that dimension F is less than dimension I, so that the height of arms (16*a*), (16*b*) or (16*c*) above their respective bases (20), when the display rack is inserted into the display box may stand above the top of the side walls (24*a*) and (24*b*) and above the top of rear wall (26) as illustrated in FIG. 3. This is simply to allow, when shipping carton (14) is removed from the display box and the articles placed, while still in the display box, on the retail sales outlet shelf, easier viewing by the consumer of the goods.

In an alternate preferred embodiment, dimension F is just slightly less than dimension I and is slightly greater than the height of the arms above the base of the display racks so that, when the shipping carton is placed over the display carton with the bottom edges of walls (24*a*), (24*b*), (26) and (28), laying just adjacent the bottom edges of walls (34*a*), (34*b*), (36) and (38), the corresponding top walls are also adjacent.

FIGS. 2 and 3 also illustrate additional features of applicant's display box (12). More specifically, that the forward portion of side walls (24*a*) and (24*b*) can be canted as seen at sections (40*a*) and (40*b*) of FIG. 3. This also helps facilitate the view of the consumer when the articles are in the display box on the shelf of the retail outlets. It is further appreciated with reference to FIGS. 2 and 3 that front wall (28) is cut down so that its height J is substantially less than the height of side walls (24*a*) and (24*b*) illustrated as dimension F in FIG. 2. This allows, again, for ease of viewing of the merchandise or goods being hung from arms (16*a*), (16*b*) or (16*c*). Further, front wall (28) is typically rectangular and may be dimensioned to receive labels or tags thereon to advertise for the goods and merchandise enclosed on the display rack. These labels are frequently placed on at the manufacturer, again to allow for greater convenience to the clerk at the retail end.

Display racks, such as the single arm rack illustrated in FIG. 1A, typically come in lengths about 16 inches to 20 inches and widths about 6, 8 and 12 inches. Display racks, such as the embodiment illustrated in FIG. 1B with two arms, namely (16*b*) and (16*c*), typically come in lengths between 16 inches to 20 inches and widths between 20 inches and 26 inches.

Goods that have been effectively and conveniently shipped according to the system of applicant's present invention include: leather hammer holders, gloves, belts, and tool holders. The articles to be shipped are typically mounted on the rack first, the loaded rack placed into the display box, and then the shipping carton is slid over the outside of the display box and secured, by tape (41) or otherwise, to the display box. The unit is then shipped to the retailer, where the retail clerk cuts the tape and slides the shipping carton off and has a display box full of goods to be displayed ready to place out on the shelves.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A system for shipping and displaying small articles, the system including:

a generally rectangular display box having a front wall, two side walls, a rear wall, and a floor, a free-standing metal rack including a support base, the support base dimensioned to fit between the side walls and between the front and rear walls of said rectangular display box, the metal rack having an article support arm for supporting the articles to be shipped and displayed therefrom, wherein the articles are placed on the article support arm of said metal rack, said metal rack inserted into said rectangular display box and the articles are shipped and displayed as mounted on said metal rack within the walls of said rectangular display box.

2. The system as set forth in claim 1 further including a generally rectangular shipping carton, said shipping carton dimensioned to enclose and lay flush against the front wall, two side walls, and the rear wall of said rectangular display box when said shipping carton is joined with said display box.

3. The system as set forth in claim 2, wherein the display box has an open top.

4. The system as set forth in claim 3, wherein the height of the front wall of said rectangular display box is less than the height of the rear wall of said rectangular display box.

5. The system as set forth in claim 2 further including means to secure said shipping carton to said rectangular display box.

6. The system as set forth in claim 5, wherein said display box has an open top.

7. The system as set forth in claim 6, wherein the support base of said metal rack is dimensioned to lay flush against the inner surfaces of the two side walls of said rectangular display box.

8. The system as set forth in claim 7, wherein the article support arm of said metal rack extends above the walls of said rectangular display box.

9. The system as set forth in claim 8, wherein the front wall of said rectangular display box is dimensioned to receive a label having indicia relating to the articles displayed therein.

10. The system as set forth in claim 9, wherein the side walls of said rectangular display box are canted downward at a non-normal angle to meet the front wall.

11. A method for transporting and displaying small articles, comprising the steps of:

providing a generally rectangular display box having a front wall, two side walls, a rear wall, a floor, and an open top, a metal rack including a support base, the support base dimensioned to fit between the side walls and between the front and rear walls of said rectangular display box, the metal rack having an article support arm for supporting the articles to be shipped and displayed therefrom, a generally rectangular shipping carton, said shipping carton dimensioned to enclose the front wall, two side walls, and the rear wall of said rectangular display box, said shipping carton having an open bottom, placing the articles to be transported and displayed on the article support arm of the metal rack, placing the metal rack with the articles thereon into the rectangular display box, placing the shipping carton over the rectangular display box, securing the shipping carton to the rectangular display box, transporting the articles to a display location, removing the shipping carton from the rectangular display box, and displaying the articles.

* * * * *